US008529284B1

(12) United States Patent
Smith

(10) Patent No.: US 8,529,284 B1
(45) Date of Patent: Sep. 10, 2013

(54) CONNECTOR LOCKING ASSEMBLY

(75) Inventor: John Smith, Piscataway, NJ (US)

(73) Assignee: Quality Computer Accessories Inc., Piscataway, NJ (US)

( * ) Notice: Subject to any disclaimer, the term of this patent is extended or adjusted under 35 U.S.C. 154(b) by 0 days.

(21) Appl. No.: 13/455,265

(22) Filed: Apr. 25, 2012

(51) Int. Cl.
*H01R 13/627* (2006.01)

(52) U.S. Cl.
USPC ..... 439/352; 439/344

(58) Field of Classification Search
USPC ..... 439/352, 344
See application file for complete search history.

(56) References Cited

U.S. PATENT DOCUMENTS

| | | | | |
|---|---|---|---|---|
| 7,204,721 | B2 * | 4/2007 | Lundholm et al. | 439/676 |
| 7,695,303 | B2 * | 4/2010 | Chen et al. | 439/352 |
| 7,892,012 | B1 * | 2/2011 | Foung | 439/352 |
| 7,976,329 | B2 * | 7/2011 | Foung | 439/352 |
| 8,267,712 | B2 * | 9/2012 | Huang et al. | 439/352 |

FOREIGN PATENT DOCUMENTS

| | | |
|---|---|---|
| TW | M413736 | 10/2011 |

* cited by examiner

*Primary Examiner* — James Harvey
(74) *Attorney, Agent, or Firm* — Bacon & Thomas, PLLC

(57) ABSTRACT

A connector locking assembly includes a cable connector, a sleeve, and a locking device. The cable connector has a pressing plate. The sleeve includes a casing and a protective plate. The casing is connected to the rear portion of the cable connector. The protective plate extends from the casing, covers the pressing plate from above, and has a through hole. A ring set extends from the rear end of the casing. The locking device is inserted into the through hole of the protective plate for interfering with the descent of the pressing plate.

16 Claims, 15 Drawing Sheets

CONNECTOR LOCKING ASSEMBLY

BACKGROUND OF THE INVENTION

1. Field of the Invention

The present invention relates to cable connectors, and more particularly, to a connector locking assembly and for providing locking and lock-releasing mechanisms thereto.

2. Description of the Related Art

Taiwan Patent M413736 discloses a safety lock assembly for a communication circuit, comprising a hollowed-out lock body and a lock-actuating device. The hollowed-out lock body receives and fastens a communication wire, such that the communication wire cannot be withdrawn from the hollowed-out lock body. The lock-actuating device is inserted into the hollowed-out lock body for releasing the communication wire which is otherwise fastened inside the hollowed-out lock body. Slots of existing electronic apparatuses (such as notebook computers or host computers) are usually arranged tightly and adjacently. As a result, if the hollowed-out lock body is overly large, ease of use will be compromised.

U.S. Pat. No. 7,976,329 discloses a connector locking device. The connector has a lock support and a locking tongue. The locking device penetrates the lock support, has a locking tongue support for supporting the locking tongue, and has a retaining mechanism connected to a release arm, and engaged with the lock support. The key has a release prong for engaging the release arm of the locking device, so as to withdraw the locking device from the lock support. The locking tongue of the connector is fully exposed; as a result, the locking tongue is likely to be compressed by an external force and severed.

SUMMARY OF THE INVENTION

It is a primary objective of the present invention to provide a connector locking assembly for fastening a cable connector in use, so as to prevent the cable connector from being disconnected at will and enhance network communication security.

In order to achieve the above and other objectives, the present invention provides a connector locking assembly, comprising a cable connector, a sleeve, and a locking device. The cable connector comprises a body and a pressing plate extending from the body. The sleeve comprises a casing and a protective plate. The casing is connected to a rear portion of the cable connector. The protective plate extends from the casing, covers the pressing plate from above, and has a through hole penetrating front and rear sides of the protective plate, the front side facing the casing. The locking device comprises a bolt, a resilient element, and a stop block. The bolt has a front portion penetrating the through hole, being positioned between the body of the cable connector and the pressing plate, and interfering with the descent of the pressing plate. The resilient element extends from the bolt and is engaged with the casing. The stop block extends from the bolt and is positioned at a rear portion of the bolt, such that the stop block is stopped at the rear side of the protective plate.

Preferably, the connector locking assembly further comprises a lock-releasing device having a top plate and a bottom plate. The top plate is disposed on the stop block and has a hook engageable with a front edge of the stop block. The bottom plate lifts the resilient element of the locking device. When the lock-releasing device is engaged with the locking device, the stop block and the resilient element of the locking device are received between the top plate and the bottom plate of the lock-releasing device, and the hook of the top plate is engaged with a front edge of the stop block, such that the bottom plate lifts the resilient element of the locking device to thereby cause the engaging block to withdraw from a mouth edge of the casing.

DETAILED DESCRIPTION OF PREFERRED EMBODIMENTS

Figure 1:
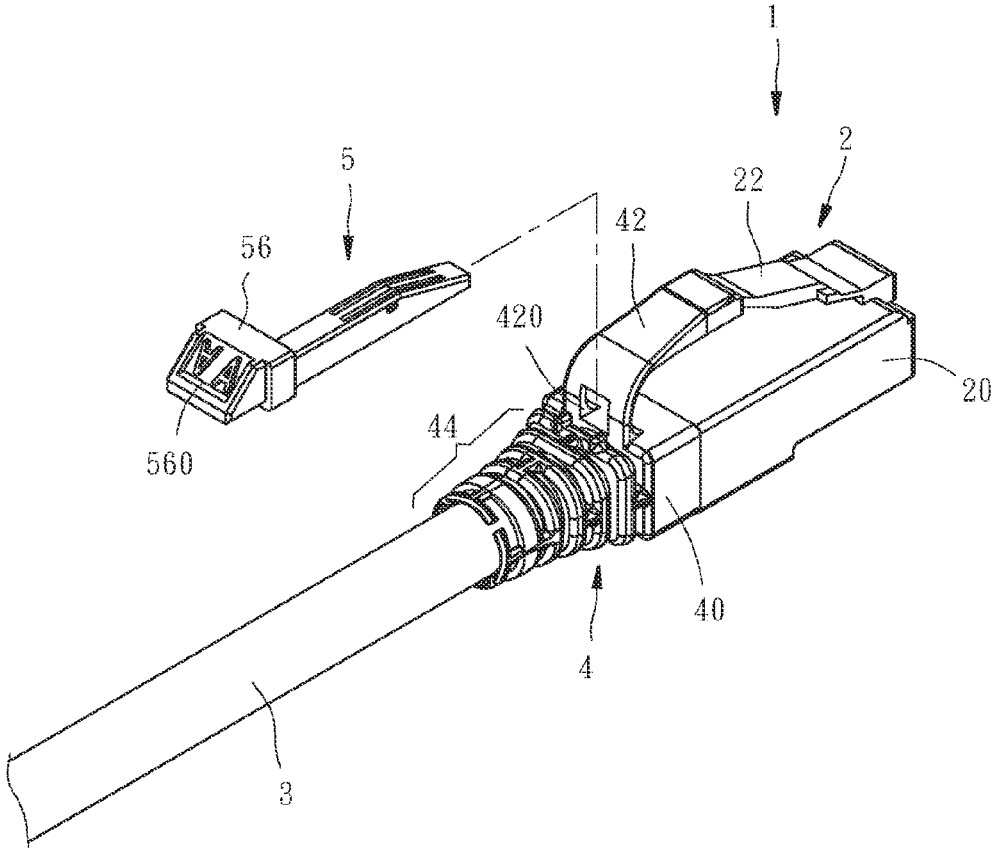
FIG. 1 is an exploded view of a connector locking assembly according to the first embodiment of the present invention.

Referring to FIG. 1, there is shown a schematic view of a connector locking assembly 1 according to a preferred embodiment of the present invention. The connector locking assembly 1 comprises a cable connector 2, a cable 3, a sleeve 4, and a locking device 5.

Figure 2:
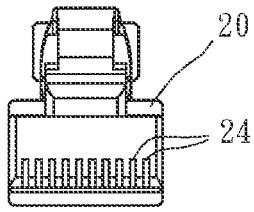
FIG. 2 is a front view of the connector locking assembly of FIG. 1.

In this embodiment, the cable connector 2 is exemplified by a RJ45 connector. The cable connector 2 comprises a body 20, a pressing plate 22, and a plurality of pins 24. The pressing plate 22 extends from the body 20 and is positioned at the front end of the body 20. The pins 24 are disposed in the body 20, as shown in FIG. 2. The cable 3 is connected to the body 20 of the cable connector 2 and comprises a plurality of wires. The wires are connected to the pins 24 in the body 20, respectively, by a one-to-one relationship. In practice, each of the two terminal ends of the cable 3 is connected to a cable connector 2. The pins 24 of each of the cable connectors 2 are electrically connected to pins in a network jack of a corresponding one of the electronic apparatuses, respectively, such that the two electronic apparatuses transmit signals and power to each other via the wires of the cable 3, as soon as two said cable connectors 2 connected to the cable 3 are inserted into the network jacks of the two electronic apparatuses, respectively. The electronic apparatuses are desktop computers, notebook computers, POS systems, phones, scanners, webcams and servers. Also, once the cable connector 2 is inserted into the network jack, the cable connector 2 will be engaged with the network jack, such that the cable connector 2 cannot be disconnected therefrom; meanwhile, if a user presses the pressing plate 22 of the cable connector 2, the cable connector 2 can be disconnected from the network jack.

The sleeve 4 comprises a casing 40, a protective plate 42, and a ring set 44. The sleeve 4 serves as a shaped covering for the cable 3 and the cable connector 2 and thereby protects the connection between the cable 3 and the cable connector 2. The casing 40 is connected to the rear portion of the cable connector 2. The protective plate 42 extends from the casing 40 and covers the pressing plate 22 from above, so as to prevent the pressing plate 22 from being severed. The protective plate 42 has a through hole 420 that penetrates its front and rear sides. The front side of the protective plate 42 faces the casing 40. The ring set 44 extends from the rear end of the casing 40 to be put around the cable 3. The ring set 44 prevents the cable 3 and the cable connector 2 from being overly bent relative to each other and disconnected. Nonetheless, in practice, the ring set 44 may be dispensed with.

Figure 3:
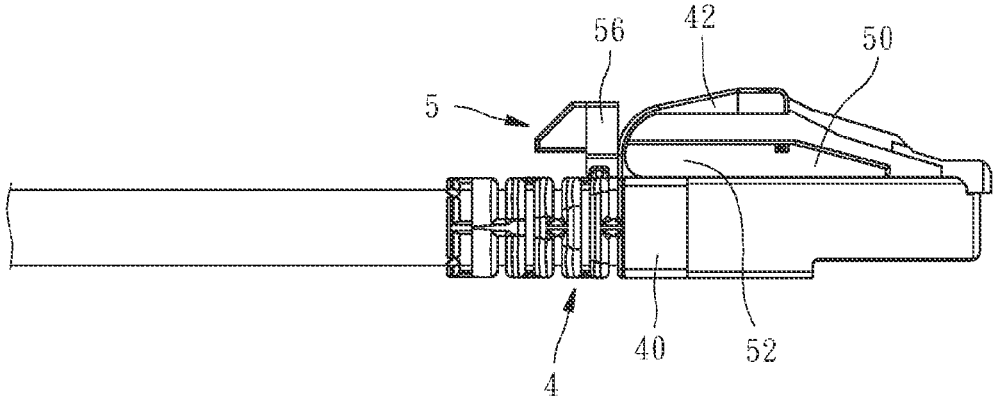
FIG. 3 is a schematic assembled view of the connector locking assembly.
Figure 4:
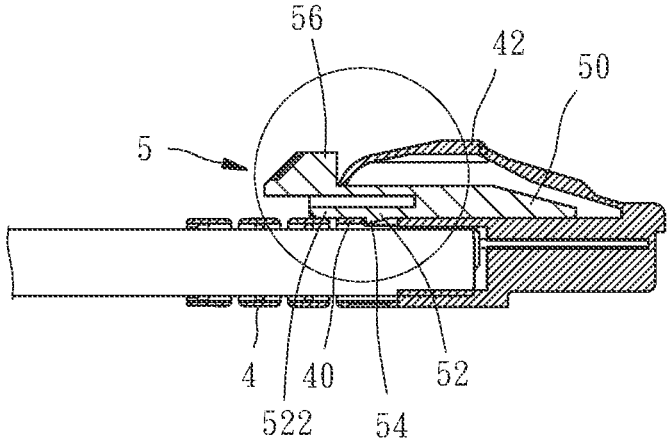
FIG. 4 is a lateral cross-sectional view of FIG. 3.

Referring to FIG. 3 and FIG. 4, there are shown schematic views of the locking device 5 inserted into the sleeve 4, respectively. The locking device 5 is designed to penetrate the through hole 420 of the protective plate 42, and comprises a bolt 50, a resilient element 52, and a stop block 56. Insertion of the locking device 5 into the through hole 420 of the protective plate 42 of the sleeve 4 causes the front portion of the bolt 50 to pass through the through hole 420, be positioned between the body 20 of the cable connector 2 and the pressing plate 22, and interfere with the distance of the descent of the pressing plate 22. Hence, the cable connectors 2 cannot be disconnected from the network jacks of the electronic apparatuses. The resilient element 52 extends from the bolt 50 and is engaged with the casing 40. The stop block 56 extends from the bolt 50 so as to be positioned at the rear portion of the bolt 50 and stopped at the rear side of the protective plate 42. As a result, the locking device 5 cannot be withdrawn from the through hole 420 of the protective plate 42.

Referring to FIG. 1 again, a label region 560 is defined on the stop block 56 of the locking device 5. The label region 560 displays a text, a symbol, a color, and/or a pattern. Two ends of a cable are usually connected to two said locking devices 5, and the label regions 560 on two said locking devices 5 are identical and identifiable by users, though the way of its application is not limited thereto.

Figure 5:
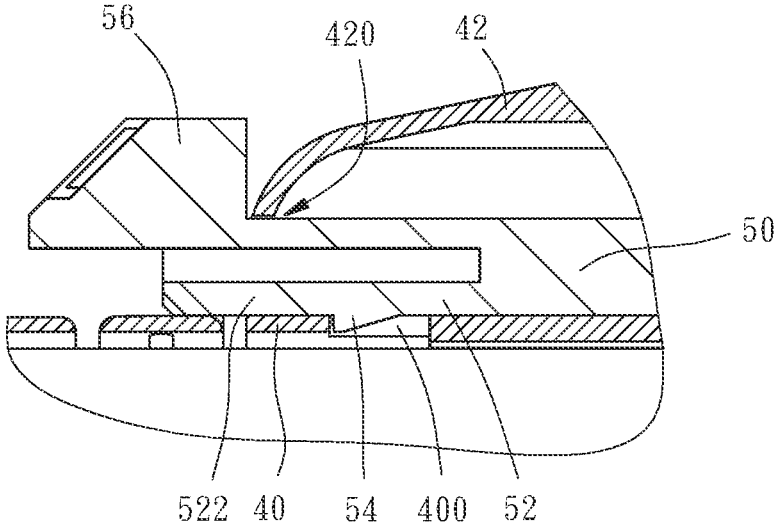
FIG. 5 is a partial enlarged view of FIG. 4.

Referring to FIG. 5, a partial enlarged view of the FIG. 4 is shown in FIG. 5 for depicting the encircled portion of FIG. 4 in detail. The casing 40 of the sleeve 4 has a notch 400. The notch 400 communicates with the casing 40 and faces the protective plate 42 of the casing 40. The resilient element 52 has an engaging block 54. The engaging block 54 is disposed in the notch 400 of the casing 40 and engaged with a mouth edge of the notch 400 of the casing 40 for preventing the locking device 5 from being reversely withdrawn from the through hole 420 of the protective plate 42.

Figure 6:
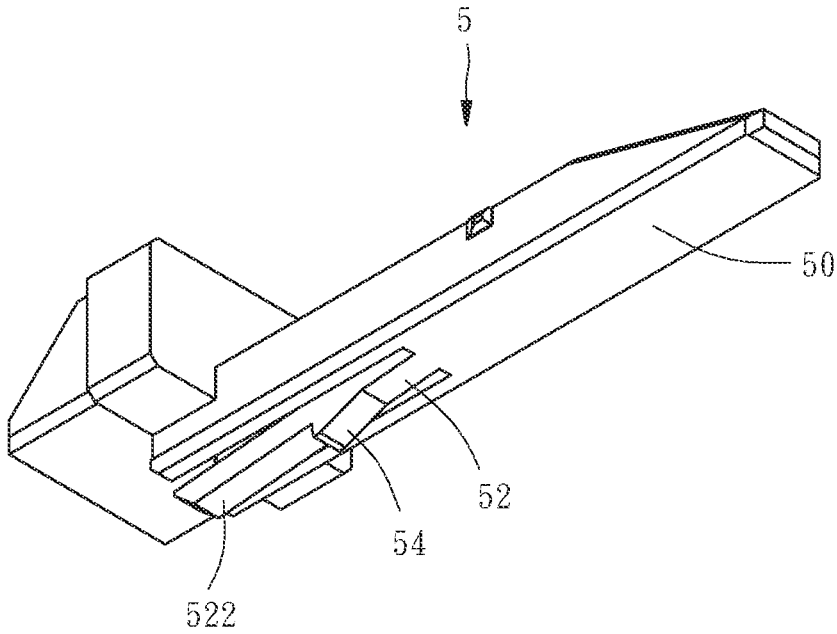
FIG. 6 is a perspective view of a locking device of FIG. 1.
Figure 7:
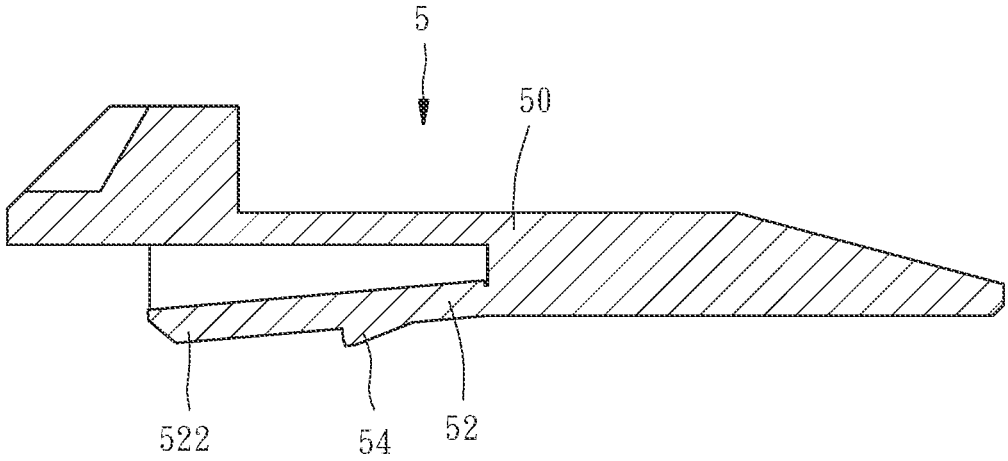
FIG. 7 is a cross-sectional view of the locking device.

Referring to FIG. 6 and FIG. 7, the resilient element 52 of the locking device 5 further has an arm 522. The arm 522 has one end connected to the bolt 50 of the locking device 5. The arm 522 tilts relative to the bolt 50. The top side of the arm 522 faces the bolt 50. The engaging block 54 is disposed on the bottom side of the arm 522 and is slightly lower than the bottom of the bolt 50. Hence, the arm 522 of the locking device 5 can swing relative to the bolt 50 resiliently and vertically.

Figure 8:
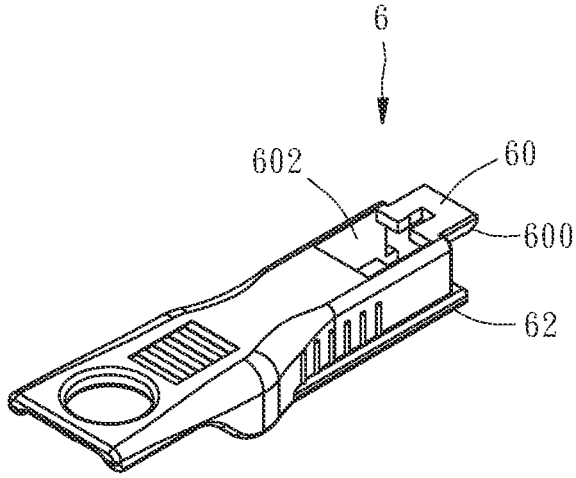
FIG. 8 is a schematic view of a lock-releasing device of the connector locking assembly.
Figure 9:
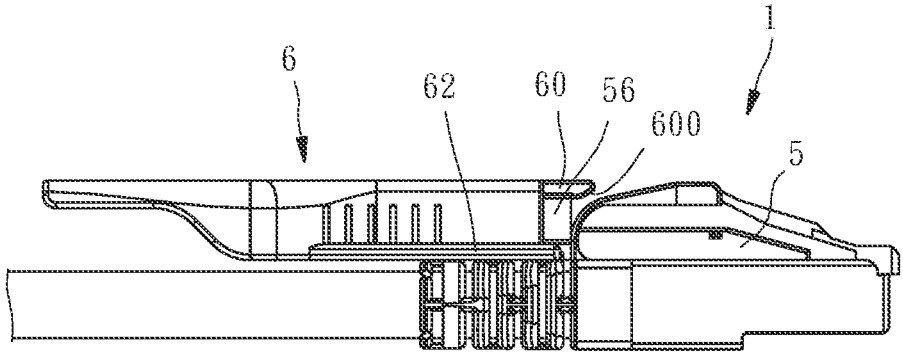
FIG. 9 is a schematic view of application of the lock-releasing device.

Referring to FIG. 8 and FIG. 9, a perspective view of a lock-releasing device 6 is shown in FIG. 8, and a schematic view of application of the lock-releasing device 6 is shown in FIG. 9. The connector locking assembly 1 further comprises a lock-releasing device 6. The lock-releasing device 6 has a top plate 60 and a bottom plate 62 and serves to unlock the locking device 5 and thereby release the cable connector 2.

Figure 10:
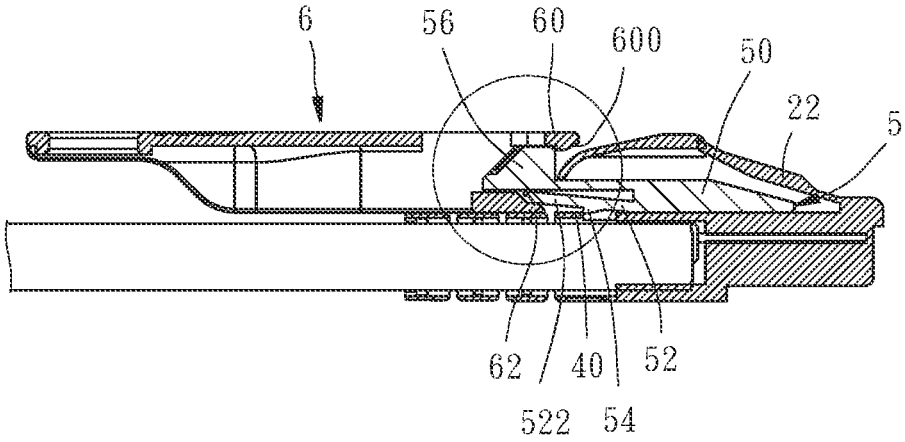
FIG. 10 is a lateral cross-sectional view of FIG. 9.
Figure 11:
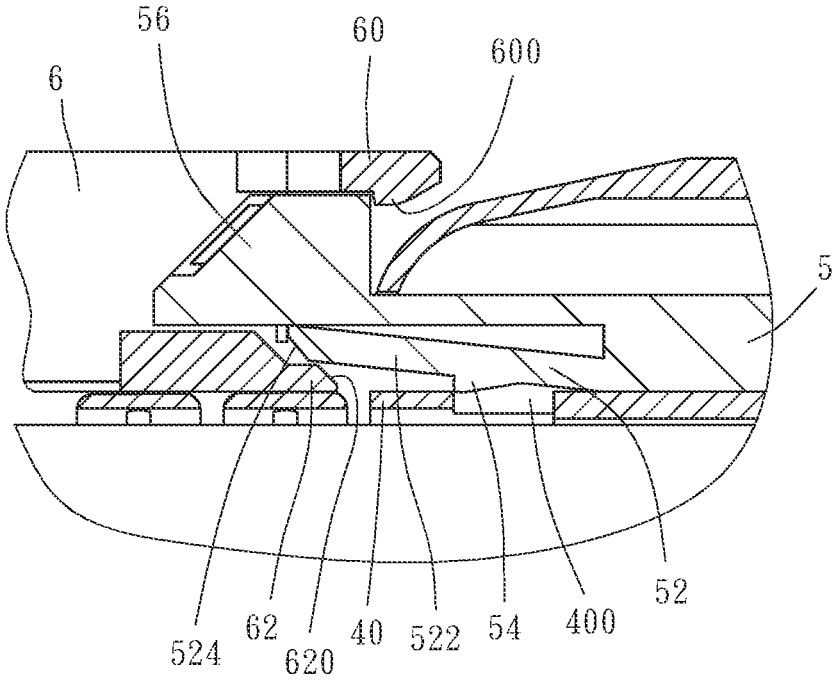
FIG. 11 is a partial enlarged view of FIG. 10.

Referring to FIG. 10 and FIG. 11, a lateral cross-sectional view of FIG. 9 is shown in FIG. 10 and FIG. 11, and a partial enlarged view of FIG. 10 is shown in FIG. 11 for depicting the encircled portion of FIG. 10 in detail. The resilient element 52 and the stop block 56 of the locking device 5 are received between the top plate 60 and the bottom plate 62 of the lock-releasing device 6. The top plate 60 has a hook 600 engageable with a front edge of the stop block 56. The bottom plate 62 lifts the resilient element 52 of the locking device 5 and thereby causes the engaging block 54 to withdraw from a mouth edge of the notch 400 of the casing 40. Hence, the locking device 5 can be reversely withdrawn by means of the lock-releasing device 6, thereby pressing the pressing plate 22 downward.

The bottom plate 62 of the lock-releasing device 6 has a ramp 620. The arm 522 of the resilient element 52 can be moved along the ramp 620 of the bottom plate 62 onto the bottom plate 62, such that not only can the bottom plate 62 be smoothly inserted into the bottom of the arm 522, but the engaging block 54 can be smoothly disconnected from the notch 400 of the casing 40.

Preferably, the arm 522 of the resilient element 52 has a ramp 524, and the angle of inclination of the ramp 524 equals that of the ramp 620 of the bottom plate 62.

Angle of inclination is between degrees of 20 to 45, but not limited to these. Hence, the ramp 524 of the arm 522 can be moved along the ramp 620 of the bottom plate 62 to reach the top side of the bottom plate 62, as soon as the lock-releasing device 6 is engaged with the locking device 5.

Figure 12:
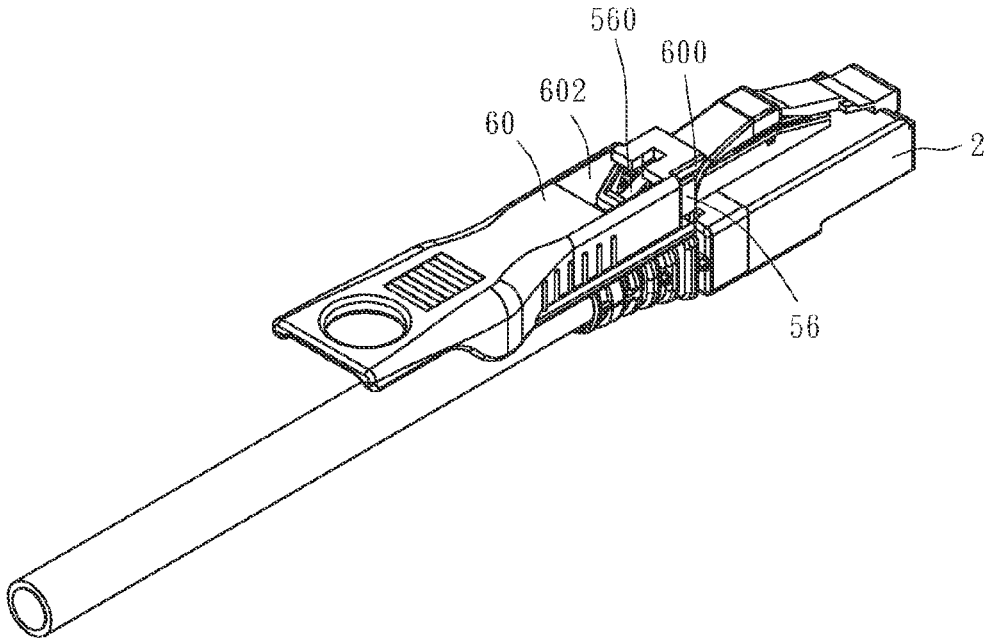
FIG. 12 is a schematic view of application of the lock-releasing device.

Referring to FIG. 8 and FIG. 12, the top plate 60 further has a window 602 adjacent to the hook 600. If the hook 600 of the top plate 60 of the lock-releasing device is engaged with the front edge of the stop block 56, the window 602 will face the label region 560 of the locking device 5.

Referring to FIGS. 13 through 19, there are shown schematic views of a connector locking assembly 1*a* according to another preferred embodiment of the present invention. In this embodiment, the connector locking assembly 1*a* comprises a cable connector 7, a sleeve 8, a locking device 9, and a lock-releasing device (not shown). The connector locking assembly 1*a* is substantially the same as the connector locking assembly 1, except that not only is the cable connector 7 of the connector locking assembly 1*a* exemplified by an LC optical fiber connector, but the sleeve 8 of the connector locking assembly 1*a* receives two cables 3*a* (such as optical fiber cables). The locking device 9 is engageable with the sleeve 8, and has a purpose and a structure which are substantially the same as that of the locking device 5.

Figure 15:
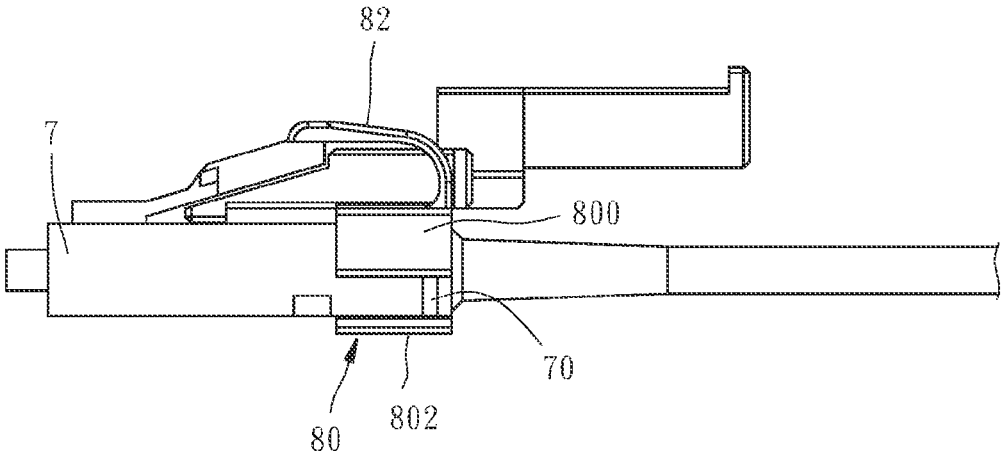
FIGS. 15 through 17 are a side view, a front view, and a bottom view of the connector locking assembly, respectively.
Figure 16:
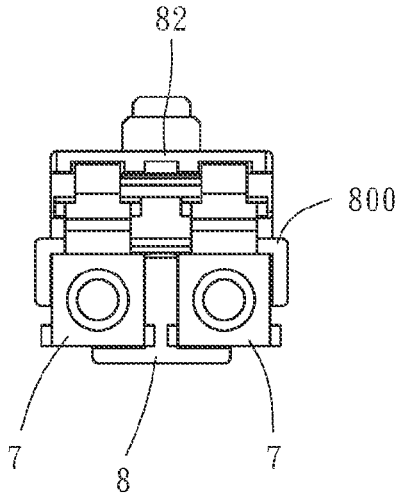
Figure 17:
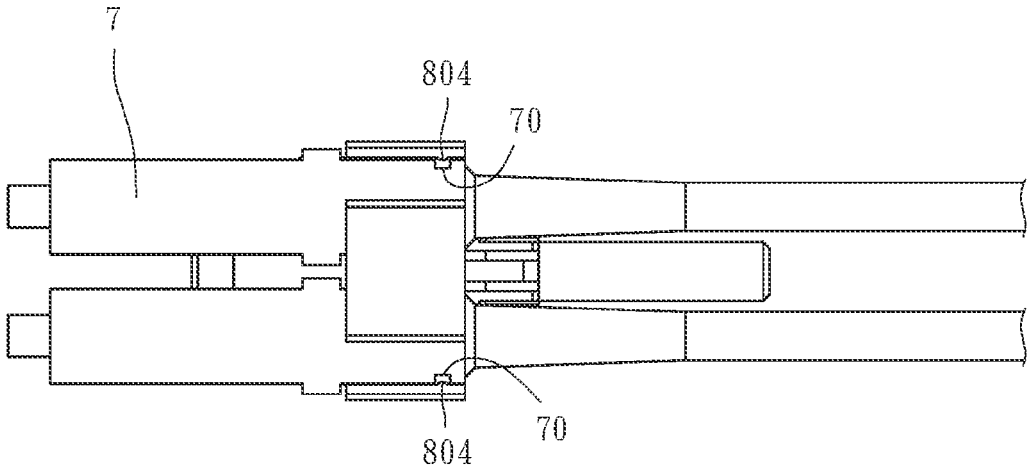

Referring to FIGS. 15 through 17, there are shown a side view, a front view, and a bottom view of the connector locking assembly 1*a*, respectively. The cable connector 7 have two chambers 70 which extend from the top of the cable connector 7 to the bottom of the cable connector 7 and are disposed on two sides of the cable connector 7, respectively. The sleeve 8 has a casing 80 and a protective plate 82. The connection and structures of the protective plate 82 and the casing 80 are identical to that of the protective plate 42 and the casing 40 and thus are not described herein again for the sake of brevity. The casing 80 has a top lid 800 and a bottom board 802. The top lid 800 has two ribs 804 positioned on two inner sides of the top lid 800, respectively. The top lid 800 covers the top of the cable connector 7. The two ribs 804 are positioned in two said chambers 70 of the cable connector 7, respectively. The bottom board 802 underpins the bottom of the cable connector 7. Hence, the casing 80 connects the cable connector 7 firmly.

Figure 13:
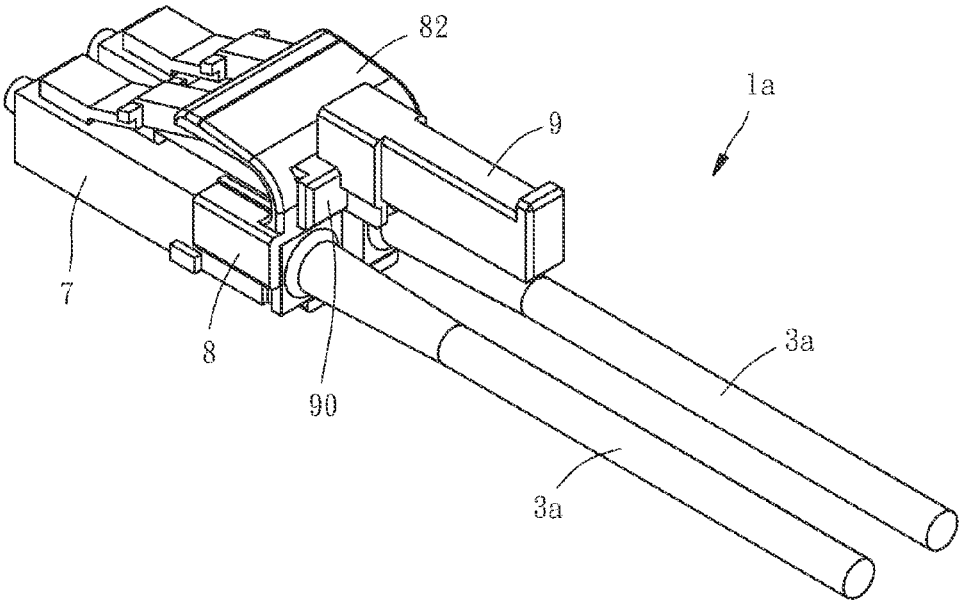
FIG. 13 and FIG. 14 are perspective views of a connector locking assembly according to the second embodiment of the present invention.
Figure 14:
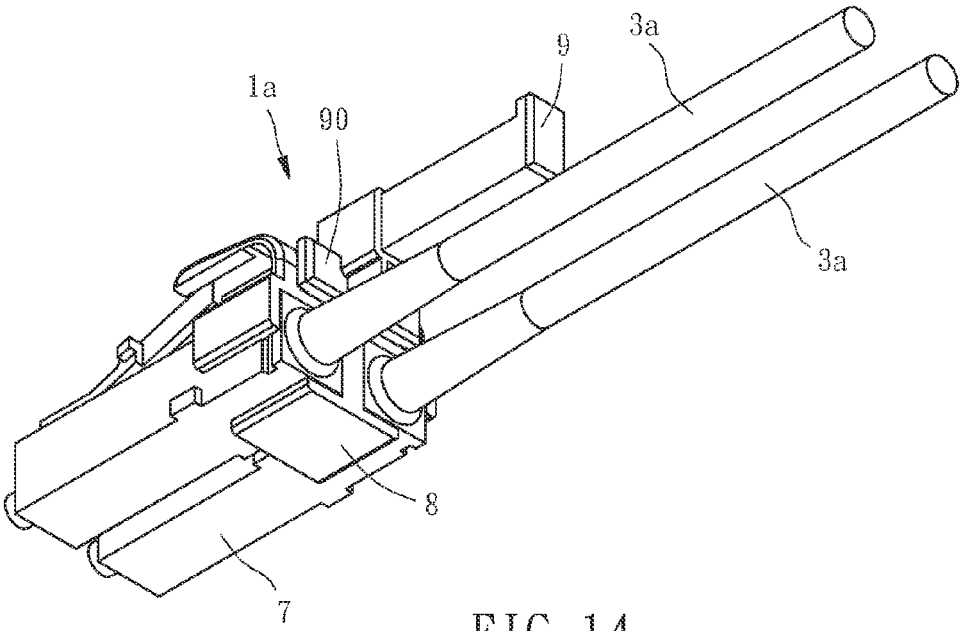
Figure 18:
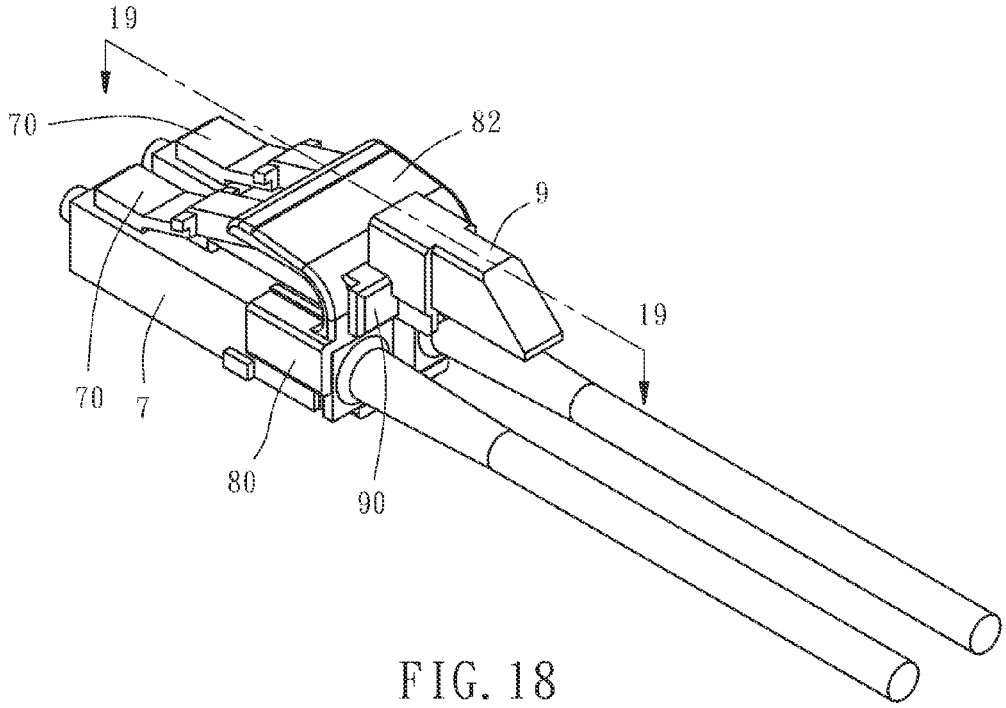
FIG. 18 is a perspective view of the connector locking assembly according to the present invention.

Referring to FIG. 13 and FIG. 18, the main difference between FIG. 13 and FIG. 18 lies in the structure of a stop block 90 of the locking device 9, whereas other structures (such as the bolts or resilient elements) shown in FIG. 13 and FIG. 18 are identical. A point to note is that the primary purpose of the stop blocks 56, 90 is to stop at the protective plates 42, 82, respectively; hence, the present invention requires that the stop blocks of the locking devices have to stop at the protective plates, but the present invention is not restrictive of the structure of the stop blocks.

Figure 19:
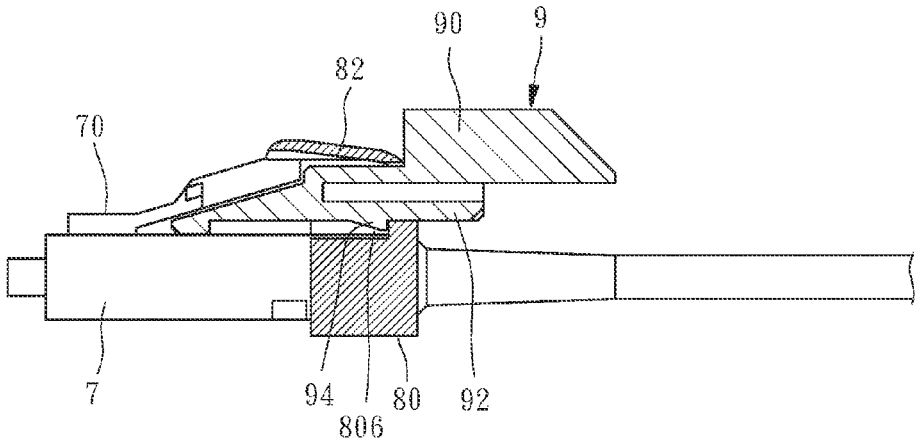
FIG. 19 is a cross-sectional view of the lock mechanism taken along line 19-19 of FIG. 18.

FIG. 18 is a perspective view of the connector locking assembly 1*a*. FIG. 19 is a cross-sectional view of FIG. 18. Referring to FIG. 18 and FIG. 19, the structure of the locking device 9 and its application-oriented relationship with the sleeve 8 are substantially the same as the related disclosure in the preceding embodiment and thus are not described herein again for the sake of brevity. The top lid 800 of the casing 80 has a notch 806. The notch 806 faces the protective plate 82. A resilient element 92 of the locking device 9 has an engaging block 94. The engaging block 94 is disposed inside the notch 806 of the top lid 800 and engaged with a mouth edge of the notch 806 of the top lid 800. Hence, the extent of the press-induced descent of a pressing plate 72 of the cable connector 7 is held in check, and thus the locking device 9 cannot be withdrawn at will.

Furthermore, the structure and purpose of a lock-releasing device in the second embodiment are the same as that of the lock-releasing device 6 in the first embodiment and thus are not described herein again for the sake of brevity.

Referring to FIGS. 20 through 24, there are drawings of the third embodiment of the present invention. A connector locking assembly in the third embodiment is substantially the same as the connector locking assembly in the first embodiment in terms of structure. A lock-releasing device 6*a* and a locking device 9*a* in the third embodiment distinguish the third embodiment from the first embodiment.

Figure 20:
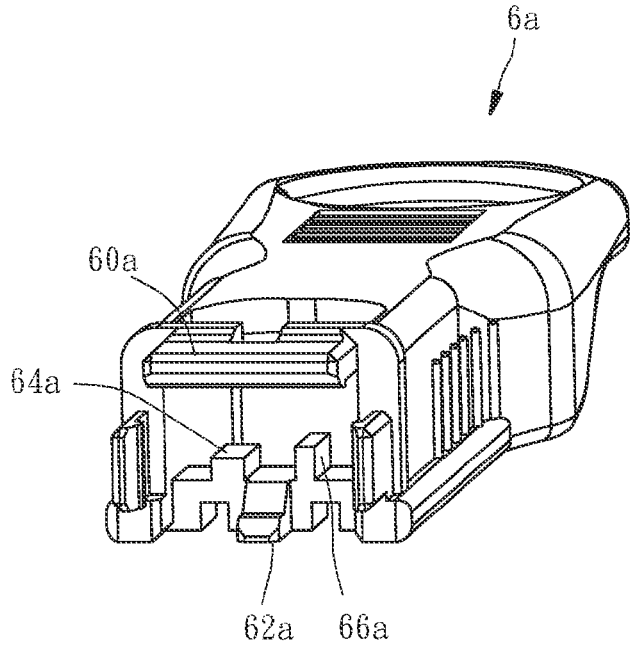
FIG. 20 is a perspective view of a lock-releasing device according to the third embodiment of the present invention.
Figure 21:
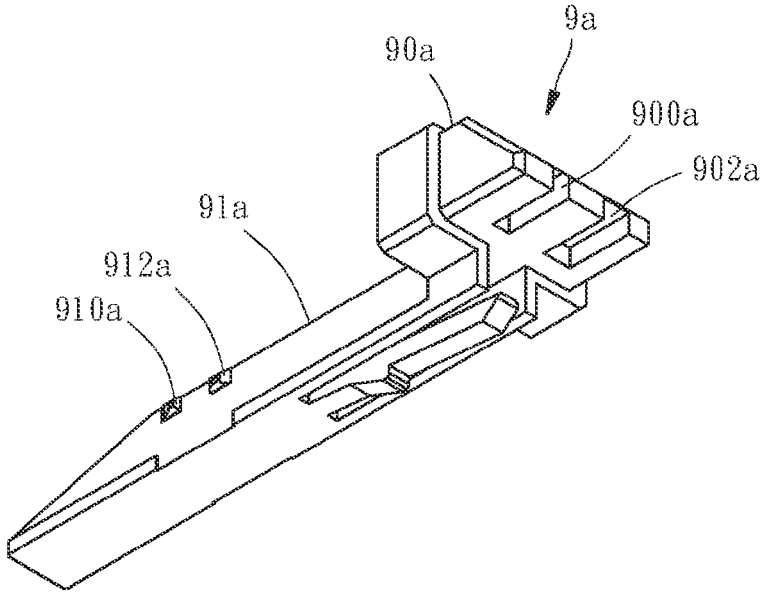
FIG. 21 is a perspective view of a locking device according to the third embodiment of the present invention.

Referring to FIG. 20, the lock-releasing device 6*a* has a top plate 60*a*, a bottom plate 62*a*, and two teeth 64*a*, 66*a*. The top plate 60*a* and the bottom plate 62*a* in the third embodiment are equal to the top plate 60 and the bottom plate 62 in the first embodiment in terms of structure and purpose and thus are not described herein again for the sake of brevity. The two teeth 64*a*, 66*a* are formed on the bottom plate 62*a* and face the top plate 60*a*. The tooth 64*a* is of a greater width than the tooth 66*a*. The tooth 64*a* is of a lesser height than the tooth 66*a*. Referring to FIG. 21, the locking device 9*a* further has two slits 900*a*, 902*a*. The two slits 900*a*, 902*a* are formed at the bottom of a stop block 90*a* and adapted to match and receive the two teeth 64*a*, 66*a*, respectively. The two teeth 64*a*, 66*a* together function as a lock-releasing portion of the lock-releasing device 6*a*, whereas the two slits 900*a*, 902*a* together function as a locking portion of the locking device 9*a*, such that the lock-releasing portion and the locking portion are matched and coupled together.

Figure 22:
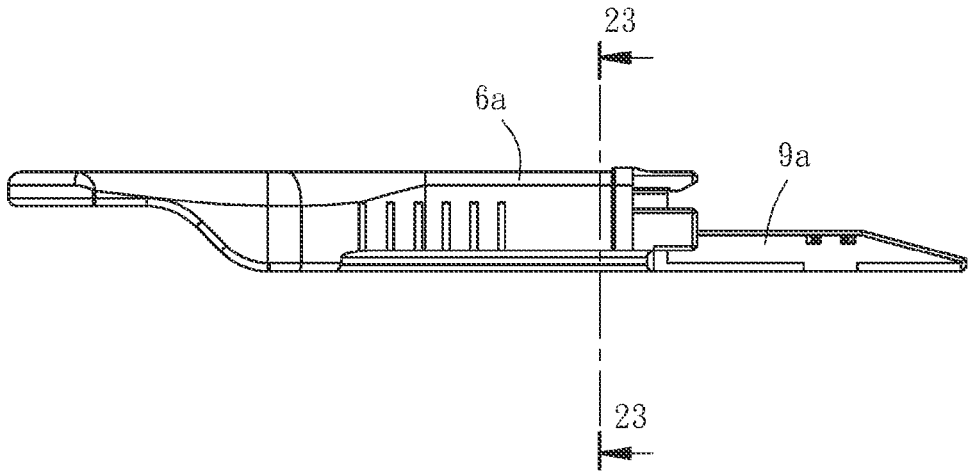
FIG. 22 is a side view of the lock-releasing device is coupled to the locking device.
Figure 23:
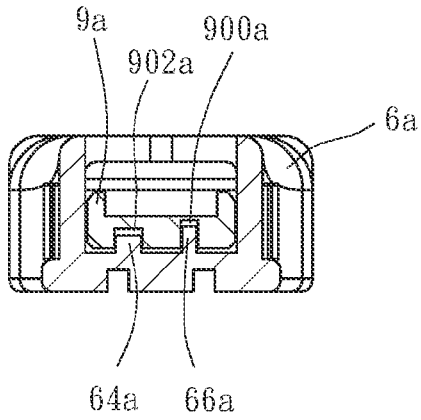
FIG. 23 and FIG. 24 are cross-sectional views of FIG. 22.

Referring to FIG. 22 and FIG. 23, the two slits 900*a*, 902*a* and the two teeth 64*a*, 66*a* are equal in width and height, such that the two teeth 64*a*, 66*a* can be inserted into the slits 900*a*, 902*a* respectively and in a one-to-one manner, so as to serve a lock-releasing purpose. Conversely, if the two teeth 64*a*, 66*a* fail to be inserted into the slits 900*a*, 902*a* respectively and in a one-to-one manner, for example, in a situation where one of the teeth 64*a*, 66*a* is wider than a corresponding one of the slits 900*a*, 902*a*, the lock-releasing device 6*a* cannot serve a lock-releasing purpose. As a result, the locking device 9*a* needs a specific said lock-releasing device 6*a* in order to serve a lock-releasing purpose.

Figure 24:
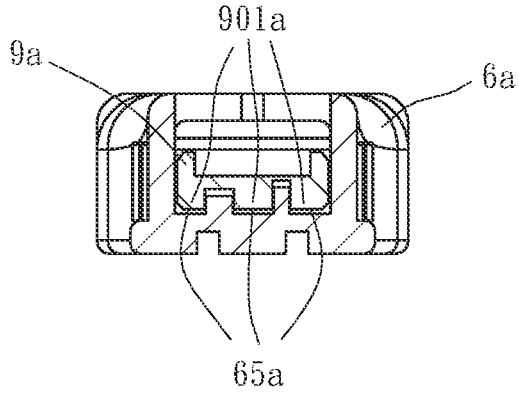

Referring to FIG. 24, alternatively, the locking portion the locking device 9*a* can be a threesome tooth 901*a*, whereas the lock-releasing portion of the lock-releasing device 6*a* can be a threesome slit 65*a*, so as to perform a lock-releasing operation that requires a specific said lock-releasing device 6*a*. The quantity, structure, and distribution of the slits 65*a*, 900*a*, 902*a* and the teeth 64*a*, 66*a*, 901*a* are not limited to the above-mentioned. Besides, the slits and the teeth can coexist on the locking portion and the lock-releasing portion, but have to meet the requirement that the lock-releasing portion and the locking portion can be matched and coupled together.

Figure 25:
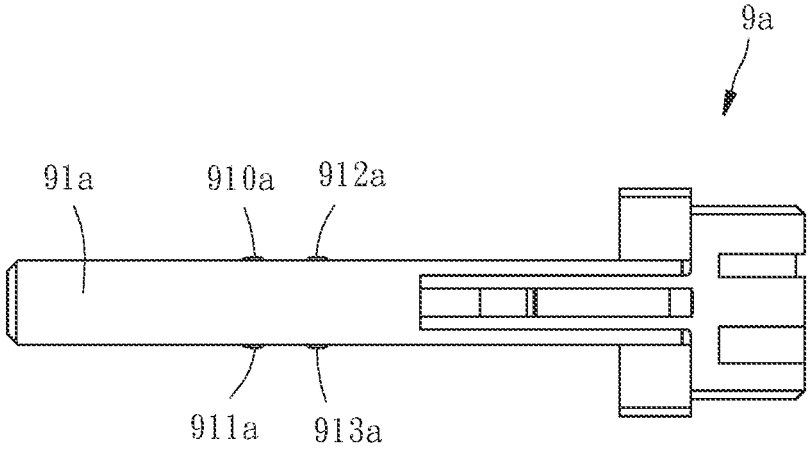
FIG. 25 is a bottom view of the locking device in FIG. 21.

Referring to FIG. 25, a bolt 91*a* of the locking device 9*a* has four bumps 910*a*, 911*a*, 912*a*, 913*a*, and the four bumps 910*a*, 911*a*, 912*a*, 913*a* are paired and disposed on two lateral sides of the bolt 91*a*, respectively. At the point in time when the bolt 91*a* of the locking device 9*a* is inserted into the through hole of the protective plate of the sleeve and the locking device 9*a* has not entered a locked state (as shown in FIG. 4), the bumps 910*a*, 911*a*, 912*a*, 913*a* are stopped at a mouth edge of the through hole, so as to prevent the locking device 9*a* from being disconnected reversely.

Figure 26:
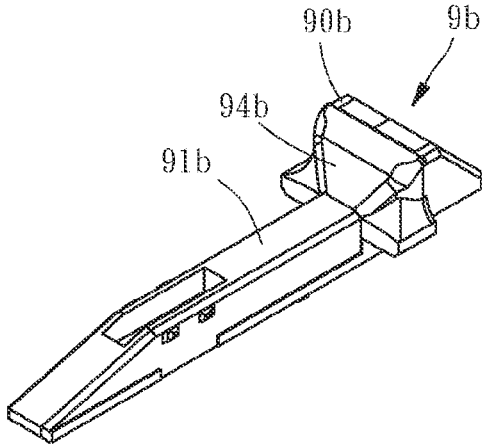
FIG. 26 is a perspective view of a locking device according to the fourth embodiment of the present invention.
Figure 27:
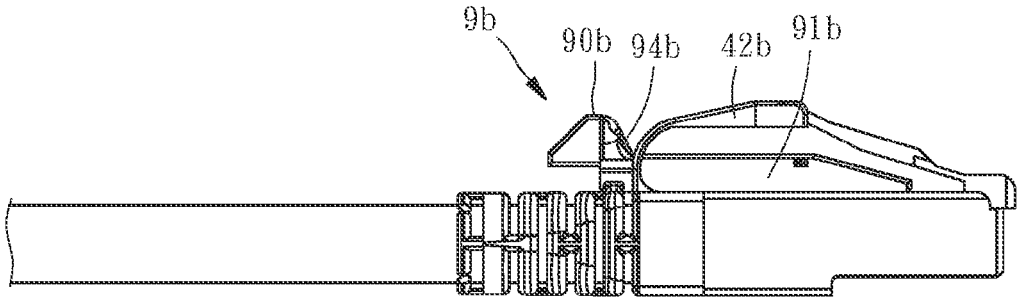
FIG. 27 is a side view of the connector locking assembly with the locking device in FIG. 26.

Referring to FIG. 26 and FIG. 27, a stop block 90*b* of a locking device 9*b* has a guiding curved surface 94*b*. The top edge of the guiding curved surface 94*b* is connected to the top of the stop block 90*b*. The bottom edge of the guiding curved surface 94*b* is connected to a bolt 91*b* of the locking device 9*b* and abuts against the rear side of a protective plate 42*b*, so as to prevent the locking device 9*b* from being forcibly damaged. For example, if a screw or a finger is inserted between the stop block 90*b* and the protective plate 42*b*, any external force exerted upon the screw or the finger will lack a preferred fulcrum, because the screw or the finger will slide along the guiding curved surface 94*b*.

In conclusion, a connector locking assembly according to the present invention is applicable to various cable connectors and thus its application is not restricted to the cable connectors in the aforesaid embodiment. The connector locking assembly according to the present invention is not only effective in preventing cable connectors which are inserted into network jacks from being disconnected at will, but also enhances the security of administration of communication network. Furthermore, the connector locking assembly comprises a protective plate for protecting a pressing plate of the cable connector and thereby preventing the pressing plate from severing under an external force.

What is claimed is:

1. A connector locking assembly, comprising:

a cable connector comprising a body and a pressing plate, the pressing plate extending from the body and positioned at a front portion of the body;

a sleeve comprising a casing and a protective plate, the casing being connected to a rear portion of the cable connector, the protective plate extending from the casing, covering the pressing plate from above, and having a through hole penetrating front and rear sides of the protective plate, the front side facing the casing; and a locking device comprising a bolt, a resilient element, and a stop block, the bolt having a front portion penetrating the through hole, being positioned between the body of the cable connector and the pressing plate, and interfering with a descent of the pressing plate, the resilient element extending from the bolt and engaged with the casing, and the stop block extending from the bolt, being positioned at a rear portion of the bolt, and being stopped at the rear side of the protective plate.

2. The connector locking assembly as defined in claim 1, wherein the casing of the sleeve has a notch communicating with the casing and facing the protective plate, and the resilient element has an engaging block disposed in the notch of the casing and engaged with a mouth edge of the notch of the casing.

3. The connector locking assembly as defined in claim 2, wherein the resilient element of the locking device further has an arm, the arm having one end connected to the bolt of the locking device, tilting relative to the bolt, and having a top side facing the bolt, and the engaging block being disposed on a bottom side of the arm.

4. The connector locking assembly as defined in claim 2, further comprising a lock-releasing device having a top plate and a bottom plate, the top plate being disposed on the stop block and having a hook engageable with a front edge of the stop block, the bottom plate lifting the resilient element of the locking device to thereby cause the engaging block to withdraw from a mouth edge of the notch of the casing.

5. The connector locking assembly as defined in claim 4, wherein the bottom plate of the lock-releasing device has a ramp whereby an arm of the resilient element is moved onto the bottom plate.

6. The connector locking assembly as defined in claim 5, wherein the arm of the resilient element has a ramp equal to the ramp of the bottom plate in an angle of inclination.

7. The connector locking assembly as defined in claim 4, wherein the stop block has a label region, and the top plate further has a window adjacent to the hook and facing the label region.

8. The connector locking assembly as defined in claim 1, wherein the stop block has a label region.

9. The connector locking assembly as defined in claim 1, wherein the cable connector have two chambers extending from a top of the cable connector to a bottom of the cable connector and are disposed on two sides of the cable connector, respectively, and the casing has a top lid and a bottom board, the top lid having two ribs positioned on two inner sides of the top lid, respectively, the top lid covering the top of the cable connector, the two ribs being positioned in two said chambers of the cable connector, respectively, and the bottom board underpinning the bottom of the cable connector.

10. The connector locking assembly as defined in claim 9, wherein the top lid of the casing has a notch facing the protective plate, and the resilient element has an engaging block disposed inside the notch of the top lid and engaged with a mouth edge of the notch of the top lid.

11. The connector locking assembly as defined in claim 10, further comprising a lock-releasing device having a top plate and a bottom plate, the top plate being disposed on the stop block and having a hook engageable with a front edge of the stop block, the bottom plate lifting the resilient element of the locking device to thereby cause the engaging block to withdraw from the notch of the top lid of the casing.

12. The connector locking assembly as defined in claim 1, further comprising a lock-releasing device engageable with the locking device and having a top plate, a bottom plate, and a lock-releasing portion, the top plate being disposed on the stop block and having a hook engageable with a front edge of the stop block, the bottom plate lifting the resilient element of the locking device, the lock-releasing portion being positioned on the bottom plate and facing the top plate, wherein the locking device further comprises a locking portion formed at a bottom of the stop block, such that the locking portion and the lock-releasing portion is matched and coupled together.

13. The connector locking assembly as defined in claim 12, wherein the lock-releasing portion has a plurality of teeth, and the locking portion has a plurality of slits, such that the teeth are inserted into the slits, respectively and in a one-to-one manner.

14. The connector locking assembly as defined in claim 12, wherein the lock-releasing portion has a plurality of slits, and the locking portion has a plurality of teeth, such that the teeth are inserted into the slits, respectively and in a one-to-one manner.

15. The connector locking assembly as defined in claim 1, wherein the bolt of the locking device has at least two bumps, and the two bumps are disposed on two lateral sides of the bolt, respectively.

16. The connector locking assembly as defined in claim 1, wherein a stop block of the locking device has a guiding curved surface with a top edge and a bottom edge, the top edge being connected to a top of the stop block, and the bottom edge being connected to the bolt and abutting against a rear side of the protective plate.

* * * * *